US005152845A

United States Patent [19]

Li

[11] Patent Number: 5,152,845

[45] Date of Patent: Oct. 6, 1992

[54] METHOD OF CLEANING USING 1-CHLORO-3,3,3-TRIFLUOROPROPANE

[75] Inventor: Chien C. Li, East Aurora, N.Y.

[73] Assignee: Allied-Signal Inc., Morris Township, Morris County, N.J.

[21] Appl. No.: 671,272

[22] Filed: Mar. 18, 1991

[51] Int. Cl.[5] ..... B01F 1/00; B08B 3/08; C23G 1/00; C23G 5/00

[52] U.S. Cl. ..... 134/40; 252/162; 252/172; 252/364; 8/142; 570/134

[58] Field of Search ..... 570/134; 134/40; 252/162, 172, 364; 8/142

[56] References Cited

U.S. PATENT DOCUMENTS 3,881,949 5/1975 Brock ..... 134/31
4,947,881 8/1990 Magid et al. ..... 134/40
5,034,149 7/1991 Merchant ..... 252/171

FOREIGN PATENT DOCUMENTS 0347924 12/1989 European Pat. Off. .
8814 3/1990 Int'l Pat. Institute .
8815 9/1990 Int'l Pat. Institute ..... 252/364

OTHER PUBLICATIONS

Chemcyclopedia, 1989, p. 57.

*Primary Examiner*—Theodore Morris
*Assistant Examiner*—Zeinab El-Arini
*Attorney, Agent, or Firm*—Melanie L. Brown; Jay P. Friedenson

[57] ABSTRACT

A method of cleaning a surface of a substrate is provided. The method comprises treating the surface with a solvent comprising 1-chloro-3,3,3-trifluoropropane.

15 Claims, No Drawings

METHOD OF CLEANING USING 1-CHLORO-3,3,3-TRIFLUOROPROPANE

BACKGROUND OF THE INVENTION

The present invention relates to a method of cleaning a surface of a substrate using 1-chloro-3,3,3-trifluoropropane as a solvent.

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room-temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the act. For example, Sherliker et al. in U.S. Pat. No. 3,085,918 disclose such suitable vapor degreasers comprising a boiling sump, a clean sump, a water separator, and other ancilliary equipment.

Cold cleaning is another application where a number of solvents are used. In most cold cleaning applications, the soiled part is either immersed in the fluid or wiped with rags or similar objects soaked in solvents.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like. Trichlorotrifluoroethane has two isomers: 1,1,2-trichloro-1,2,2-trifluoroethane (known in the art as CFC-113) and 1,1,1-trichloro-2,2,2-trifluoroethane (known in the art as CFC-113a).

Chlorofluorocarbons (CFC) such as 113 are suspected of causing environmental problems in connection with the ozone layer. In August 1988, the U.S. Environmental Protection Agency issued its final rules ordering a freeze on CFC production including CFC-113 at 1986 levels by mid-1989. Additional 20% and 50% cuts in CFC production are scheduled for 1993 and 1998.

In response to the need for stratospherically safe materials, substitutes have been developed and continue to be developed. *Research Disclosure* 14623 (June 1978) reports that 1,1-dichloro-2,2,2-trifluoroethane (known in the art as HCFC-123) is a useful solvent for degreasing and defluxing substrates. In the EPA "Findings of the Chlorofluorocarbon Chemical Substitutes International Committee", EPA-600/9-88-009 (April 1988 , it was reported on pages C-22 and C-23 that HCFC-123 and 1-fluoro-1,1-dichloroethane (known in the art as HCFC-141b) have potential as replacements for CFC-113 as cleaning agents.

Commonly assigned U.S. Pat. No. 4,947,881 teaches a method of cleaning using hydrochlorofluoropropanes having 2 chlorine atoms and a difluoromethylene group. European Publication 347,924 published Dec. 27, 1989 teaches hydrochlorofluoropropanes having a difluoromethylene group. International Publication Number WO 90/08814 published Aug. 9, 1990 teaches azeotropes having at least one hydrochlorofluoropropane having a difluoromethylene group.

A wide variety of consumer parts is produced on an annual basis in the United States and abroad. Many of these parts have to be cleaned during various manufacturing stages in order to remove undesirable contaminants. These parts are produced in large quantities and as a result, substantial quantities of solvents are used to clean them. It is apparent that the solvent used must be compatible with the material to be cleaned.

Solvents should be stabilized against possible changes during storage and use. One problem with CFC-113 is that it hydrolyzes to form HCl. When metallic materials are present such as occurs in many cleaning applications, the problem is worsened because the metal acts as a catalyst and causes the hydrolysis of CFC-113 to increase exponentially. Metallic materials such as Al-2024, copper, cold rolled steel, galvanized steel, and zinc are commonly used in cleaning apparatus. Another potential change is due to ultraviolet light decomposing CFC-113. This hydrolysis problem also occurs with hydrochlorofluorocarbon solvents such as 1,1-dichloro-2,2,2-trifluoroethane (known in the art as HCFC-123) because chlorine and hydrogen atoms are on the same carbon or adjacent carbons.

It is an object of the invention to provide a novel solvent for cleaning substrates.

It is another object of the invention to provide such a novel solvent which is stratospherically safer than currently used solvents.

SUMMARY OF THE INVENTION

The objects of the invention are achieved by treating the surface of a substrate with a solvent comprising 1-chloro-3,3,3-trifluoropropane (known in the art as HCFC-253fb). Because CFC-113 and HCFC-123 readily hydrolyze, I was surprised to find that 1-chloro-3,3,3-trifluoropropane, a hydrochlorofluorocarbon, undergoes no hydrolysis when saturated with water. I believe that HCFC-253fb will be a better solvent than CFC-113 because HCFC-253fb contains —Cl and —H.

In addition to its usefulness in cleaning applications, the present solvent is advantageous because it has a low atmospheric lifetime.

DETAILED DESCRIPTION OF THE PREFERRED EMBODIMENTS

The 1-chloro-3,3,3-trifluoropropane used in the present invention is commercially available from Halocarbon Products Company or may be prepared by reacting commercially available carbon tetrachloride and ethylene at low temperature in the presence of hydrogen fluoride as a catalyst to form 1,1,1,3-tetrachloropropane. The hydrogen fluoride then serves as a fluorination agent to convert the 1,1,1,3-tetrachloropropane to 1-chloro-3,3,3-trifluoropropane.

The present method removes most contaminants from the surface of a substrate. For example, the present method removes organic contaminants such as mineral oils from the surface of a substrate. Under the term "mineral oils", both petroleum-based and petroleum-derived oils are included. Lubricants such as engine oil, machine oil, and cutting oil are examples of petroleum-derived oils.

The present method also removes water from the surface of a substrate. The method may be used in the single-stage or multi-stage drying of objects.

The present method may be used to clean the surface of inorganic and organic substrates. Examples of inorganic substrates include metallic substrates, ceramic substrates, and glass substrates. Examples of organic substrates include polymeric substrates such as polycarbonate, polystyrene, and acrylonitrile-butadiene-styrene. The method also may be used to clean the surface of natural fabrics such as cotton, silk, fur, suede, leather, linen, and wool. The method also may be used to clean the surface of synthetic fabrics such as polyester, rayon, acrylics, nylon, and blends thereof, and blends of synthetic and natural fabrics. It should also be understood that composites of the foregoing materials may be cleaned by the present method. The present method may be particularly useful in cleaning the surface of polycarbonate, polystyrene, and ABS substrates.

The present method may be used in vapor degreasing, solvent cleaning, cold cleaning, dewatering, and dry cleaning. In these uses, the object to be cleaned is immersed in one or more stages in the liquid and/or vaporized solvent or is sprayed with the liquid solvent. Elevated temperatures, ultrasonic energy, and/or agitation may be used to intensify the cleaning effect.

The present invention is more fully illustrated by the following non-limiting Examples.

COMPARATIVE A

Seven day stability tests were done with commercial grade CFC-113 as follows:

Commercial grade CFC-113 was saturated with water at room temperature. 125 ml of CFC-113 was transferred into a 250 ml Pyrex flask which was connected to a water/glycol cooled condenser.

On top of the condenser, a "Drierite" desiccant was provided to prevent ambient moisture leaking into the solvent. A metal coupon was situated in the middle of the liquid-vapor phase. A total of eight common metal alloys were investigated. They are: Aluminum-2024(hereinafter Al-2024), Copper(hereinafter Cu), Cold Rolled steel(hereinafter CRS), and Galvanized Steel(hereinafter GS), SS 304, SS 304L, SS 316, and SS 316L.

The solvent then was under total reflux at its boiling temperature for seven days. Observation was made daily on the change of the metal surface including the loss of luster of the metal surface and stain or corrosion on the metal surface, if any and the solvent including coloration of the solvent, increased viscosity of the solvent and most importantly, the rate of change of the viscosity.

The pH values were determined for each solvent before and after the test. The Cl ion concentration in the solvent was determined by ion chromatography.

The pH was about 6 in the presence of Al-2024 and was about 5.9 in the presence of the other metals. The results are in Table I below. In Table I, NC means No Change, C means corroded, WD means White Deposit, CL means colorless, and SY means Slightly Yellow.

TABLE I

| | Al-2024 | Cu | CRS | GS |
|---|---|---|---|---|
| $Cl^-$ (ppm) | 5.7 | 5.8 | 4.9 | 11 |
| Metal | NC | NC | C | WD |
| Solvent | CL | CL | SY | CL |

The results indicate that in the presence of Al-2024, Cu, CRS, or GS, CFC-113 undergoes hydrolyzes to form HCl.

COMPARATIVE B

Comparative A was repeated except that HCFC-123 was used instead of CFC-113.

The pH was about 4.8 in the presence of Al-2024 and was about 3.5 in the presence of the other metals. The results are in Table II below. In Table II, S means stained, SC means slightly corroded, C means corroded, VC means very corroded, CL means colorless, and G means gray with suspended particles.

TABLE II

| | Al-2024 | Cu | CRS | GS |
|---|---|---|---|---|
| $Cl^-$ (ppm) | 13 | 74 | 69 | 5100 |
| Metal | S | SC | C | VC |
| Solvent | CL | CL | CL | G |

The results indicate that in the presence of Al-2024, Cu, CRS, or GS, HCFC-123 undergoes hydrolyzes to form HCl. Compared with CFC-113, HCFC-123 hydrolyzes to a greater extent.

EXAMPLE 1

Comparative A was repeated except that 1-chloro-3,3,3-trifluoropropane was used instead of CFC-113.

The pH was about 6.9 in the presence of Al-2024 and was about 6.9 in the presence of the other metals. The results are in Table III below. In Table III, NC means No Change, CL means colorless.

TABLE III

| | Al-2024 | Cu | CRS | GS |
|---|---|---|---|---|
| $Cl^-$ (ppm) | <1 | <1 | <1 | <1 |
| Metal | NC | NC | NC | NC |
| Solvent | CL | CL | CL | CL |

The results indicate that in the presence of Al-2024, Cu, CRS, and GS, HCFC-253fb undergoes substantially no hydrolysis and any hydrolysis which HCFC-253fb undergoes is minimal compared with the hydrolysis which CFC-113 or HCFC- 123 undergoes under the same conditions. Considering that HCFC-123 and HCFC-253fb differ by only a $—CH_2$ and —Cl, this result is unexpected.

EXAMPLE 2

1-chloro-3,3,3-trifluoropropane was added to mineral oil in a weight ratio of 50:50 at 27° C. The 1-chloro- 3,3,3-trifluoropropane was completely miscible in the mineral oil.

EXAMPLES 3-22

The present method is used to clean the following contaminants from the following substrates.

| Example | Contaminant | Substrate |
|---|---|---|
| 3 | engine oil | metal |
| 4 | machine oil | ceramic |
| 5 | cutting oil | glass |
| 6 | water | polymeric |
| 7 | engine oil | fabric |
| 8 | machine oil | metal |
| 9 | cutting oil | ceramic |
| 10 | water | glass |
| 11 | engine oil | polymeric |
| 12 | machine oil | fabric |
| 13 | cutting oil | metal |
| 14 | water | ceramic |
| 15 | engine oil | glass |
| 16 | machine oil | polymeric |
| 17 | cutting oil | fabric |
| 18 | water | metal |
| 19 | engine oil | ceramic |
| 20 | machine oil | glass |
| 21 | cutting oil | polymeric |
| 22 | water | fabric |

Having described the invention in detail and by reference to preferred embodiments thereof, it will be apparent that modifications and variations are possible without departing from the scope of the invention defined in the appended claims.

What is claimed is:

1. A method of dissolving contaminants or removing contaminants from the surface of a substrate selected from the group consisting of inorganic substrates, organic substrates, natural fabrics and synthetic fabrics which comprises the step of:

using a solvent consisting essentially of 1-chloro-3,3,3-trifluoropropane to substantially dissolve or remove said contaminants.

2. The method of claim 1 wherein said method removes organic contaminants from said surface.

3. The method of claim 1 wherein said method removes water from said surface.

4. The method of claim 1 wherein said method substantially removes contaminants from the surface of an inorganic substrate.

5. The method of claim 1 wherein said method substantially removes contaminants from the surface of a metallic substrate.

6. The method of claim 1 wherein said method substantially removes contaminants from the surface of a ceramic substrate.

7. The method of claim 1 wherein said method substantially removes contaminants from the surface of a glass substrate.

8. The method of claim 1 wherein said method substantially removes contaminants from the surface of an organic substrate.

9. The method of claim 1 wherein said method substantially removes contaminants from the surface of a polymeric substrate.

10. The method of claim 1 wherein said method substantially removes contaminants from the surface of a polycarbonate substrate.

11. The method of claim 1 wherein said method substantially removes contaminants from the surface of a polystyrene substrate.

12. The method of claim 1 wherein said method substantially removes contaminants from the surface of a natural fabric or synthetic fabric selected from the group consisting of cotton, wool, silk, fur, suede, leather, linen, polyester, rayon, acrylic, nylon, and blends thereof.

13. The method of claim 1 wherein said method substantially dissolves said contaminants.

14. The method of claim 1 wherein said method substantially removes said contaminants from the surface of the substrate.

15. The method of claim 1 wherein said method substantially dissolves organic contaminants.

* * * * *